US007159320B2

(12) United States Patent
Moore

(10) Patent No.: US 7,159,320 B2
(45) Date of Patent: Jan. 9, 2007

(54) TOOL FOR FORMING A CANDLE-RECEIVING OPENING IN A FRUIT OR VEGETABLE

(76) Inventor: Kelly A. Moore, 207 Williamsburg Dr., Van Alstyne, TX (US) 75495

( * ) Notice: Subject to any disclaimer, the term of this patent is extended or adjusted under 35 U.S.C. 154(b) by 0 days.

(21) Appl. No.: 11/148,917

(22) Filed: Jun. 9, 2005

(65) Prior Publication Data

US 2006/0277766 A1 Dec. 14, 2006

(51) Int. Cl.
*B26B 3/00* (2006.01)

(52) U.S. Cl. ..... 30/113.1; 30/301; 30/302; 30/316

(58) Field of Classification Search ..... 30/113.1, 30/113.3, 301, 302, 303, 304, 305, 314, 315, 30/316

See application file for complete search history.

(56) References Cited

U.S. PATENT DOCUMENTS

| | | | | |
|---|---|---|---|---|
| 436,043 | A * | 9/1890 | Maranville | 30/301 |
| 468,893 | A * | 2/1892 | Palmiter | 30/301 |
| 917,660 | A | 4/1909 | Roberts | |
| 1,568,008 | A * | 12/1925 | Thomas | 30/113.3 |
| 1,590,633 | A * | 6/1926 | Lee | 30/301 |
| 1,595,574 | A * | 8/1926 | Quevli | 30/302 |
| 2,117,278 | A | 5/1938 | Ainsworth | |
| 2,202,064 | A | 5/1940 | Olsen | |
| 2,263,531 | A | 11/1941 | Kevorkian | |
| 3,770,865 | A | 11/1973 | Ralles | |
| 4,818,215 | A | 4/1989 | Taga | |
| 4,905,375 | A * | 3/1990 | Braswell | 30/316 |
| 4,955,807 | A | 9/1990 | Chance et al. | |
| 6,705,741 | B1 | 3/2004 | Bonnema et al. | |
| 2004/0093738 | A1 * | 5/2004 | Mauro | 30/113.1 |
| 2005/0229405 | A1 * | 10/2005 | Endres et al. | 30/305 |

* cited by examiner

*Primary Examiner*—Hwei-Siu Payer
(74) *Attorney, Agent, or Firm*—Haynes and Boone, LLP

(57) ABSTRACT

A small hand tool is provided for forming in a fruit or vegetable an exterior surface recess for complementarily receiving a tealight candle. The tool has a hollow cylindrical body centered around an axis and having a sharpened lower end portion, and a handle projecting axially upwardly from the top end of the body. A diametrically extending, laterally twisted cutting blade member is positioned within a lower end portion of the body and has a cutting edge portion lying in a plane transverse to the body axis. To form the candle receiving recess the tool body is pushed and twisted into the fruit or vegetable, until the top end of the tool body is flush with the outer side of the fruit or vegetable, and then pulled outwardly therefrom.

14 Claims, 2 Drawing Sheets

TOOL FOR FORMING A CANDLE-RECEIVING OPENING IN A FRUIT OR VEGETABLE

BACKGROUND OF THE INVENTION

The present invention generally relates to apparatus for securing a candle to an underlying structure and, in a representative embodiment thereof, more particularly provides a tool useable to form in a fruit or vegetable an exterior recess configured to complementarily receive a tealight candle to form with the fruit or vegetable a decorative item.

In the past, candles of various configurations have been supported within the interiors of carved out pumpkins to internally illuminate them for Halloween festivities. For decorative purposes it would be desirable to support a small candle, such as a "tealight" candle, in an exterior surface recess of a fruit or vegetable, with the inserted candle being essentially flush with the outer side surface of the fruit or vegetable. However, using known cutting tools it would be difficult to precisely form this type of recess in a fruit or vegetable which would complementarily and closely receive the inserted candle such that essentially all of its inserted side and inner end surface area was engaged by corresponding interior surface portions of the recess.

It would thus be desirable to provide a hand operable tool for this purpose. It is to this goal that the present invention is directed.

SUMMARY OF THE INVENTION

In carrying out principles of the present invention, in accordance with a representative embodiment thereof, a tool is provided for forming an outer side surface recess in a fruit or vegetable for the complementary receipt therein of a cylindrical candle, illustratively a tealight candle having a diameter and a height.

From a broad perspective, the tool comprises a hollow cylindrical body centered about an axis and having an upper end, a sharpened lower end edge portion spaced apart from the upper end along the axis, and an outer diameter substantially equal to the diameter of the candle-receiving recess to be formed. A handle structure is secured to the tool body and is manually graspable and useable to downwardly force the sharpened lower end edge of the body into the fruit or vegetable while rotating the body about its axis. A cutting blade structure is secured within a lower end portion of the body and has a cutting edge portion positioned and configured to provide the innermost end surface of the formed candle-receiving recess with a substantially entirely flat configuration.

To achieve this flat innermost recess end configuration, the cutting edge portion of the blade structure preferably lies in a plane transverse to the body axis, with the plane being positioned axially inwardly of the lower circular bottom edge of the tool body, and the cutting edge portion extending from diametrically opposite interior side surface portions of the body to a relatively small laterally central portion thereof. To automatically provide the fruit or vegetable recess with a depth substantially identical to the height of the inserted candle, the axial distance between the cutting edge plane and the upper end of the tool body is made to be substantially identical to the height of the candle. Thus, as the body is being pushed and rotated into the fruit or vegetable, when the upper end of the tool body is substantially flush with the adjacent outer surface of the fruit or vegetable, the insertion of the body into the fruit or vegetable is terminated, and the body is axially removed from the fruit or vegetable.

Preferably, the cutting blade structure is defined by an elongated strip-shaped cutting member longitudinally extending diametrically across the interior of said body and being secured at opposite ends thereof to said body. The cutting member is laterally twisted about a longitudinally central portion thereof to form a pair of opposite longitudinal blade portions with preferably sharpened side edges lying in the previously mentioned plane transverse to the body axis, these side edges defining the cutting edge portion of the cutting blade structure. The pair of opposite longitudinal blade portions are laterally tilted relative to one another, illustratively at a tilt angle of about ninety degrees.

The diametrically extending, laterally twisted cutting blade structure not only provides the innermost end of the formed candle-receiving recess with a substantially entirely flat configuration, but also underlies and supports the separated fruit or vegetable portion within the tool body interior when the tool body reaches its final depth within the fruit or vegetable. Accordingly, when the tool body is pulled out of the fruit or vegetable, the diametrically extending cutting blade structure exerts a removal force on the removed fruit or vegetable portion along a portion of its inner end extending between diametrically opposite portions thereof to substantially facilitate removal of this cored portion of the fruit or vegetable with the removed tool body.

In an illustrated embodiment of the tool, the upper end of the body has an open configuration, and the tool further comprises an elongated support member longitudinally extending diametrically across the upper end of the body and being secured at opposite ends thereto. The handle structure includes an elongated first portion longitudinally extending along the body axis and having an inner end secured to the support member, and an outer end, and a second portion secured to and extending transversely to the outer end of the first handle portion. Preferably, the length of the diametrically extending cutting blade structure extends parallel to the length of the support member.

The tool is preferably provided with a hollow cylindrical protective sleeve member with a closed end portion, the sleeve member being removably placeable coaxially over a portion of the tool body to cover its sharpened lower end edge portion with the closed end portion of said sleeve member.

DETAILED DESCRIPTION

Figure 1:
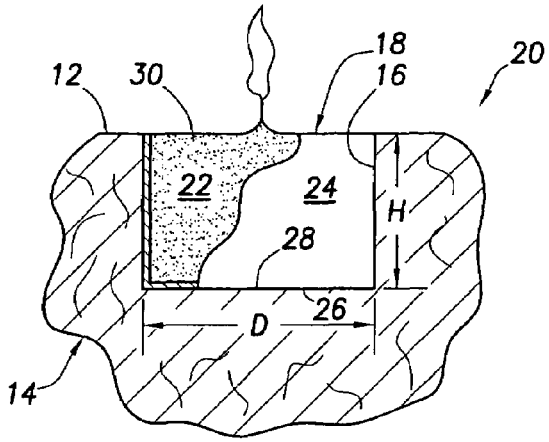
FIG. 1 is a schematic cross-sectional view through a representative fruit or vegetable having a top side surface recess formed therein by a specially designed tool of the present invention and complementarily receiving a tealight candle.
Figure 3:
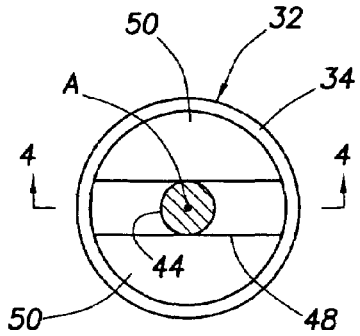
FIG. 3 is a cross-sectional view through the tool taken along line 3—3 of FIG. 2.
Figure 2:
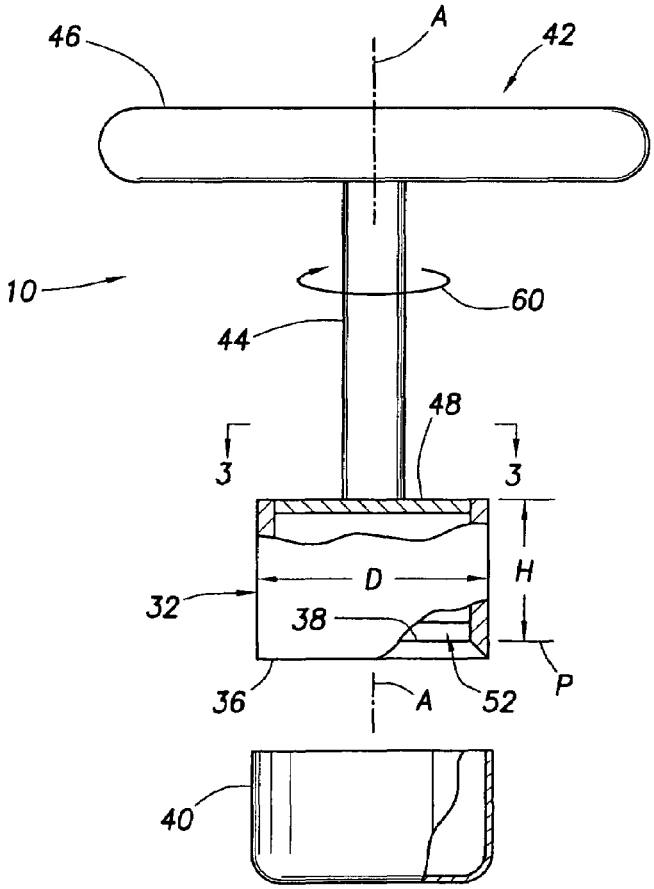
FIG. 2 is a partially exploded and sectioned side elevational view of the tool.
Figure 4:
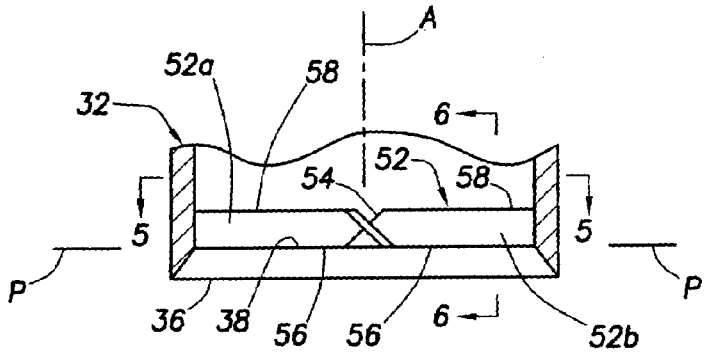
FIG. 4 is an enlarged partial cross-sectional view through a lower body end portion the tool taken along line 4—4 of FIG. 3.

With initial reference to FIGS. 1 and 2, the present invention provides a specially configured hand tool 10 (see FIG. 2) which may be used to form, in the top side 12 of a fruit or vegetable 14, a cylindrical recess 16 (see FIG. 1) configured to complementarily receive a conventional tealight candle 18 and form therewith a decorative item 20.

Tealight candle 18 comprises a cylindrical candle 22 complementarily received in an open-topped cylindrical metal outer shell 24 having a height H and a flat circular bottom wall 26 having a diameter D. Similarly, the recess 16 has a height H and a flat circular bottom surface 28 with a diameter D. Accordingly, when the tealight candle 18 is downwardly inserted into the fruit or vegetable recess 16, the bottom side 26 of the tealight candle 18 is parallel to and abuts the innermost flat bottom surface 28 of the recess 16, and the top side 30 of the tealight candle 18 is substantially flush with the top side 12 of the fruit or vegetable 14.

Referring now to FIGS. 2–6, the tool 10, which is preferably formed from stainless steel but could be alternatively formed from a variety of other suitable materials, has a tubular body portion 32 with an open top end 34, and an open bottom end with a sharpened, upwardly and radially inwardly tapering annular lower edge portion 36 having an annular upper side edge 38 at the interior side surface of the body portion 32. As illustrated, body portion 32 is centered about a vertical reference axis A, with the upper annular edge 38 of the sharpened lower body edge portion 36 lying in a reference plane P (see FIG. 4) transverse to the axis A. As shown in FIG. 2, the vertical distance between the upper annular edge 38 to the top end 34 of the tool body 32 is equal to the candle height dimension H shown in FIG. 1, and the outer diameter of the body 32 is equal to the candle diameter D shown in FIG. 1. Preferably, the tool 10 is provided with an open-topped hollow elastomeric protective sleeve 40 which may be slipped upwardly over the lower end of the tool body 32, when the tool 10 is not in use, to protectively cover the sharpened lower edge portion 36.

Projecting upwardly from the top end 34 of the tool body 32 is a T-handle 42 having an elongated vertical portion 44 longitudinally extending along the axis A, and an elongated horizontal portion 46 transversely secured to its upper end. The lower end of the vertical handle portion 44 is suitably anchored to a central portion of an elongated rectangular horizontal support plate 48 secured to and diametrically extending along the open top end of the tool body 32. As can best be seen in FIG. 3, body top end openings 50 are defined on horizontally opposite sides of the support plate 48 as viewed in FIG. 3.

With continuing reference to FIGS. 2–6, according to a key aspect of the present invention, the tool 10 is provided with a specially configured and positioned elongated cutting blade member 52. Cutting blade member 52 is basically an elongated rectangular metal strip which longitudinally extends diametrically across a bottom interior end portion of the tool body 32 and is suitably secured at its opposite ends to the interior side surface of the body 32 just above the annular edge 38. Preferably, the blade member 52 longitudinally extends parallel to the length of the top end support plate 48.

The cutting blade member 52 is laterally twisted (through an angle X which is representatively about 90 degrees) about a small longitudinally central portion 54 thereof to define opposite blade portions 52*a* and 52*b* having lower side edges 56 (which are preferably sharpened) that lie in the plane P, and upper side edges 58. From their lower side edges 56, the longitudinally opposite blade portions 52*a* and 52*b* slope upwardly in laterally opposite directions to their upper side edges 58.

Figure 5:
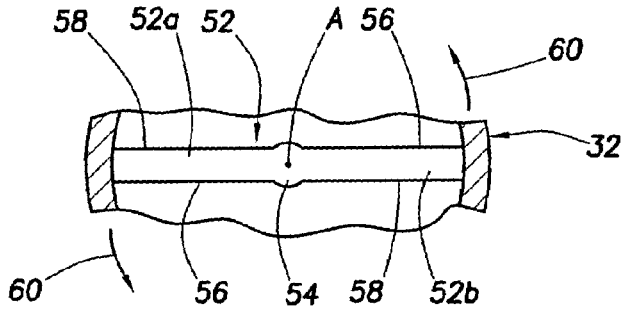
FIG. 5 is a partial cross-sectional view through the tool taken along line 5—5 of FIG. 4.
Figure 6:
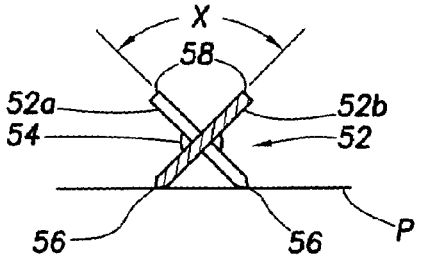
FIG. 6 is an enlarged scale cross-sectional view through a laterally twisted cutting blade portion of the tool taken along line 6—6 of FIG. 4.

TO form the candle recess 16 in the fruit or vegetable 14, a user simply grasps the upper end portion 46 of the T-handle 42 from above and, with the protective sleeve 40 removed from the tool 10 presses the sharpened annular lower body end edge 36 into surface 12 of the fruit or vegetable 14, at the desired location thereon of the candle-receiving recess 16, and then pushes the body 32 downwardly into the fruit or vegetable 14, while rotating the body 32 about the axis A in the direction of the arrows 60 in FIGS. 2 and 5 (in a clockwise direction as viewed from the top of the tool 10) until the top end 34 of the body 32 is essentially flush with the top surface 12 of the fruit or vegetable 14.

The user then stops pushing and rotating the tool 10. At this point, a core portion of the fruit or vegetable 14 has been sliced through by the cutting blade member 52 and overlies it within the interior of the tool body 32. Importantly, since the cutting edge portion of the blade member 52 (i.e., the lower side edges 56 of its longitudinal portions 52*a*,52*b*) lie in a plane P transverse to the vertical tool axis A about which the tool body 32 has been rotated, the circular bottom side surface 28 of the now-formed candle recess 16 is now substantially flat like the bottom side 26 of the tealight candle which will be subsequently inserted into the recess 16 formed by the tool 10.

Next, the user simply lifts the inserted tool body portion 32 out of the fruit or vegetable 14. The entire cut-out portion of the fruit or vegetable 14 is lifted out with the body 32, being supported on an entire diametrically extending portion of its underside by the elongated cutting blade member 52. The user may then simply push out the removed cut-out fruit or vegetable portion, via the top end openings 50 in the body 32, through the open bottom side of the tool body 32.

Finally, the user inserts the tealight candle 18 into the fruit or vegetable recess 16. The inserted tealight candle 18 is complementarily and neatly received in the recess 18 with the flat bottom 26 of the candle 18 engaging the similarly flat bottom surface 28 of the recess 16, and the top side 30 of the candle being essentially flush with the top side 12 of the fruit or vegetable 14

As can be seen from the foregoing, the specially configured and positioned cutting blade member 52 desirably provides the bottom side surface 28 of the recess 16 with a substantially flat configuration, and also supports the cut-out fruit or vegetable portion along an entire diametrical portion of its bottom side to facilitate its removal.

While the cutting blade member is preferably of a laterally twisted configuration, cutting blade structures having other configurations may be utilized without departing from principles of the present invention. Also, while the cutting edge portion of the illustrated cutting blade member extends clear across an internal diameter of the tool body, an alternatively configured cutting blade member, having a cutting edge portion lying in a plane perpendicular to the rotational axis of the tool, which does not extend completely across the interior of the tool body may be alternatively utilized to provide the candle-receiving recess with a bottom surface which is essentially planar may also be used without departing from principles of the present invention.

The foregoing detailed description is to be clearly understood as being given by way of illustration and example only, the spirit and scope of the present invention being limited solely by the appended claims.

What is claimed is:

1. A tool forming a recess in a fruit or vegetable, the recess being configured to complementarily receive a cylindrical candle having a diameter and a height, said tool comprising:

a hollow cylindrical body centered about an axis and having an upper end, a sharpened lower end edge portion spaced apart from said upper end along an axis, and an outer diameter substantially equal to the diameter of the candle-receiving recess to be formed;

a handle structure secured to said body and being manually graspable and useable to downwardly force said sharpened lower end edge portion into the fruit or vegetable while rotating said body about said axis; and a cutting blade structure secured within a lower end portion of said body and having a cutting edge portion positioned and configured to provide the innermost end surface of the formed candle-receiving recess with a substantially entirely flat configuration, said cutting blade structure is being defined by an elongated strip-shaped cutting member longitudinally extending diametrically across the interior of said body and being secured at opposite ends thereof to said body, said cutting member being laterally twisted about a longitudinally central portion thereof to form a pair of opposite longitudinal blade portions with side edges lying in a plane transverse to said axis, said side edges defining said cutting edge portion.

2. The tool of claim 1 wherein:

the axial distance between said plane and said upper end of said body is substantially equal to the height of the recess.

3. The tool of claim 1 wherein:

said sharpened lower end edge portion has an axially outermost circular edge, and said plane is positioned axially inwardly of said circular edge.

4. The tool of claim 1 wherein:

said cutting edge portion extends from diametrically opposite interior portions of said body to a laterally central interior portion of said body.

5. The tool of claim 1 wherein:

said side edges of said blade portions have sharpened configurations.

6. The tool of claim 1 wherein:

the axial distance between said plane and said upper end of said body is substantially equal to the height of the recess.

7. The tool of claim 1 wherein:

said sharpened lower end edge portion has an axially outermost circular edge, and said plane is positioned axially inwardly of said circular edge.

8. The tool of claim 1 wherein:

said pair of opposite longitudinal blade portions are laterally tilted relative to one another.

9. The tool of claim 1 wherein:

said pair of opposite longitudinal blade portions are laterally tilted relative to one another at an angle of about ninety degrees.

10. The tool of claim 1 wherein:

said upper end of said body has an open configuration, said tool further comprises an elongated support member longitudinally extending diametrically across said upper end of said body and being secured at opposite ends thereto, and said handle structure includes an elongated first portion longitudinally extending along said axis and having an inner end secured to said support member, and an outer end, and a second portion secured to and extending transversely to said outer end of said first portion.

11. The tool of claim 10 wherein:

said cutting blade structure longitudinally extends parallel to the length of said support member.

12. The tool of claim 1 further comprising:

a hollow cylindrical protective sleeve member with a closed end portion, said sleeve member being removably placeable coaxially over a portion of said body to cover said sharpened lower end edge portion with said closed end portion of said sleeve member.

13. A tool for forming a recess in a fruit or vegetable, the recess being configured to complementarily receive a cylindrical candle having a diameter and a height, said tool comprising:

a hollow cylindrical body centered about an axis and having an upper end, a sharpened lower end edge portion spaced apart from said upper end along said axis, and an outer diameter substantially equal to the diameter of the candle-receiving recess to be formed;

a handle structure secured to said body and being manually graspable and useable to downwardly force said sharpened lower end edge portion into the fruit or vegetable while rotating said body about said axis; and a generally strip-shaped cutting blade structure longitudinally extending diametrically across and secured at opposite ends thereof within a lower end portion of said body, said cutting blade structure having a cutting edge portion positioned and configured to provide the innermost end surface of the formed candle-receiving recess with a substantially entirely flat configuration, said cutting edge portion being defined by sharpened, laterally offset opposite side edges of longitudinal portions of said cutting blade structure between which said axis extends.

14. A tool for forming a recess in a fruit or vegetable, the recess being configured to complementarily receive a cylindrical candle having a diameter and a height, said tool comprising:

a hollow cylindrical body centered about an axis and having an upper end, a lower end edge portion spaced apart from said upper end along said axis, and an outer diameter substantially equal to the diameter of the candle-receiving recess to be formed;

a handle structure secured to said body and being manually graspable and useable to downwardly force said lower end edge portion into the fruit or vegetable while rotating said body about said axis; and a generally strip-shaped cutting blade structure secured to and longitudinally extending within a lower end portion of said body, said cutting blade structure having a cutting edge portion positioned and configured to provide the innermost end surface of the formed candle-receiving recess with a substantially entirely flat configuration, said cutting edge portion lying in a plane transverse to said axis and including a sharpened edge of a longitudinal portion of said cutting blade structure having a width tilted at an angle relative to said plane.

* * * * *